United States Patent [19]

Fox

[11] 4,383,384

[45] May 17, 1983

[54] FOLDING STOCK FOR FIREARMS AND FIREARMS EMPLOYING SAME

[75] Inventor: Gerard J. Fox, Meriden, Conn.

[73] Assignee: Dean Machine Products, Inc., Manchester, Conn.

[21] Appl. No.: 212,542

[22] Filed: Dec. 3, 1980

[51] Int. Cl.[3] ..... F41C 23/00

[52] U.S. Cl. ..... 42/72; 42/75 C

[58] Field of Search ..... 42/71 R, 72, 73, 75 C

[56] References Cited

U.S. PATENT DOCUMENTS

| | | | |
|---|---|---|---|
| 521,202 | 6/1894 | Burgess . | |
| 543,138 | 7/1895 | Murray . | |
| 931,328 | 8/1909 | Marble . | |
| 1,222,778 | 4/1917 | McCleary . | |
| 1,315,215 | 9/1919 | Davidson . | |
| 1,651,299 | 11/1927 | Stansel . | |
| 2,400,349 | 5/1946 | Haberstump . | |
| 2,437,548 | 3/1948 | Patchett . | |
| 2,462,091 | 2/1949 | Garand . | |
| 2,466,017 | 4/1949 | Farber . | |
| 3,060,625 | 10/1962 | Glass et al. . | |
| 3,137,958 | 6/1964 | Lewis et al. . | |
| 3,267,601 | 8/1966 | Roy . | |
| 3,570,162 | 3/1971 | Suddarth | 42/73 X |
| 3,618,249 | 11/1971 | Grandy . | |
| 3,798,819 | 3/1974 | Hillberg . | |

FOREIGN PATENT DOCUMENTS

| | | | |
|---|---|---|---|
| 628732 | 9/1949 | United Kingdom | 42/72 |

OTHER PUBLICATIONS

J. Weeks, ed;, *Jane's Infantry Weapons,* (London: Jane's Publishing Co., 1979), pp. 84, 85, and 191.

I. Hogg & J. Weeks, *Military Small Arms of the Twentieth Century,* (Northfield, Ill.: Digest Books, 1973), pp. 2.21–2.22.

*Primary Examiner*—Charles T. Jordan

*Assistant Examiner*—Ted L. Parr

[57] ABSTRACT

A folding stock includes a butt plate that assumes its operational orientation in both the extended and the folded positions of the stock. A pivot arm is pivotably mounted on a mount that is adjustably inserted into recesses in the rear of the receiver of the weapon. The pivot arm pivots about the mount pivot axis at its one end and has a butt member pivotably mounted at its other end. The butt member has a horizontal stock portion and a vertical butt-plate portion at the rear. A spring fastened to the mount acts as a lock for both the pivot arm and the butt member.

11 Claims, 7 Drawing Figures

FOLDING STOCK FOR FIREARMS AND FIREARMS EMPLOYING SAME

BACKGROUND OF THE INVENTION

The present invention relates to firearms having collapsible stocks, particularly the type in which the stock is foldable.

The need has long been recognized for firearms in which the stock can be collapsed from its ordinary, extended position. The collapsed position is useful during storage and transport of the weapon and during transport of personnel carrying weapons in close quarters. Furthermore, tactical situations develop in which it can be expected that firing from the hip will be necessary, and the collapsed position of the stock is accordingly preferred in those situations.

Over the years, the need for a collapsible stock has been met by a number of arrangements. The sliding stock, for instance, is locked into a rearward position for ordinary use and is then unlocked and slid forward to achieve the collapsed position. This type of stock typically has the added benefit that a number of extended positions can be selected to fit the size of the soldier employing the weapon. A further advantage of the sliding stock is that its rear surface or butt plate naturally assumes an orientation in the collapsed position that contributes to comfort during firing from the hip. On the other hand, this type of stock has the disadvantage that it ordinarily extends rather far forward along the side of the receiver in the collapsed position, thereby interfering somewhat with comfortable grasping of the weapon for firing.

In addition to the sliding stock, the folding stock also provides a collapsed position. The folding stock, which pivots at one or more points to fold into a compact assembly, lacks some of the advantages of the sliding stock. However, it does not ordinarily extend as far forward in its collapsed position as the sliding stock does, so it is less likely to interfere with a comfortable grasp of the weapon.

It is an object of the present invention to provide a foldable stock that retains the usual advantages of the foldable stock while affording some of the advantages of the sliding stock.

SUMMARY OF THE INVENTION

The foregoing and related objects are achieved in a firearm comprising a receiver portion, a barrel extending from one end of the receiver portion, and a foldable stock assembly on the other end of the receiver portion. The foldable stock includes an elongated arm and pivot means detachably secured to the one end of the pivot arm on the receiver portion. The pivot arm is mounted on the pivot means for movement between a first position, in which the pivot arm extends away from the other end of the receiver portion, and a second position, in which the pivot arm extends towards the barrel. The foldable stock assembly also has a butt member including an elongated stock portion and a butt-plate portion at its one end. The stock portion is pivotably mounted on the pivot arm adjacent the other end of the pivot arm for pivoting between a first position, in which the stock portion extends away from the receiver portion and rearwardly of the pivot arm when the pivot arm is in its first position, and a second position, in which it extends longitudinally of the firearm along the upper surface of the receiver portion when the pivot arm is in its second position. The one end of the butt member is disposed rearwardly of the receiver portion in either of its positions. Also, the butt portion extends at an angle to the longitudinal axis of the stock portion to bear against the body of a user when the butt member is in either of the pivoted positions.

It is beneficial for the firearm to include pivot-arm locking means for locking the pivot arm in its first position and butt-member locking means for locking the butt member in its first position when the pivot arm is in its first position. In the illustrated embodiment, the pivot-arm locking means includes resiliently deflectable spring means on the pivot means and an engagement surface on the pivot arm. The spring means provides a detent, and the engagement surface is spaced from the pivot axis of the pivot means to move upon pivoting of the pivot arm. The engagement surface engages the spring means and is disposed in the detent in it when the pivot arm is in the first position, and pivoting of the pivot arm from the first position requires movement of the engagement surface out of the detent by resilient deflection of the spring means. The spring means and the engagement surface thereby lock the pivot arm in its first position. The butt-member locking means includes second resiliently deflectable spring means, also including a detent, on the pivot means and an engagement surface on the stock portion of the butt member spaced from the pivot axis of the butt member. The engagement surface engages the second spring means and is disposed in its detent when the butt member and the pivot arm are in their first positions. Movement of the butt member out of the first position requires movement of the engagement surface out of the detent by resilient deflection of the spring means. The spring means and the engagement surface thereby lock the butt member in its first position.

The illustrated pivot means includes a body portion and at least one elongated finger portion extending longitudinally from the body portion. The receiver portion provides a longitudinally extending recess in its rear associated with each finger portion of the pivot means that receives the associated finger portion in it.

The pivot arm may include a pair of generally elongated pivot plates, each of which is pivotably mounted at its one end on the body portion of the pivot means for pivoting about the pivot axis of the pivot means. Each of the pivot plates would also be pivotably mounted at its other end on the butt member for pivoting about the pivot axis of the butt member. The pivot plates may be horizontally spaced and extend longitudinally along opposite sides of the receiver portion when the pivot arm is in its second position. This type of pivot arm can include a locking bar extending between the pivot plates at their one end and spaced from the pivot axis of the pivot means to extend under the pivot means when the pivot arm is in the first position. The pivot means would include spring means providing a detent receiving the locking bar when the pivot arm is in the first position. Pivoting of the pivot arm from the first position requires movement of the locking arm out of the detent by resilient deflection of the spring means. The locking bar and the spring means thereby lock the pivot arm in its first position.

The receiver portion typically provides a rear sight on its upper surface near its rear, and the stock portion of the butt member preferably has an aperture in which the rear sight is received when the pivot arm and butt member are in their second positions.

Conveniently, the butt member may be inclined from the horizontal in its first position.

BRIEF DESCRIPTION OF THE DRAWINGS

These and further features and advantages of the present invention are described in connection with the accompanying drawings, in which.

DETAILED DESCRIPTION OF THE PREFERRED EMBODIMENT

Figure 1:
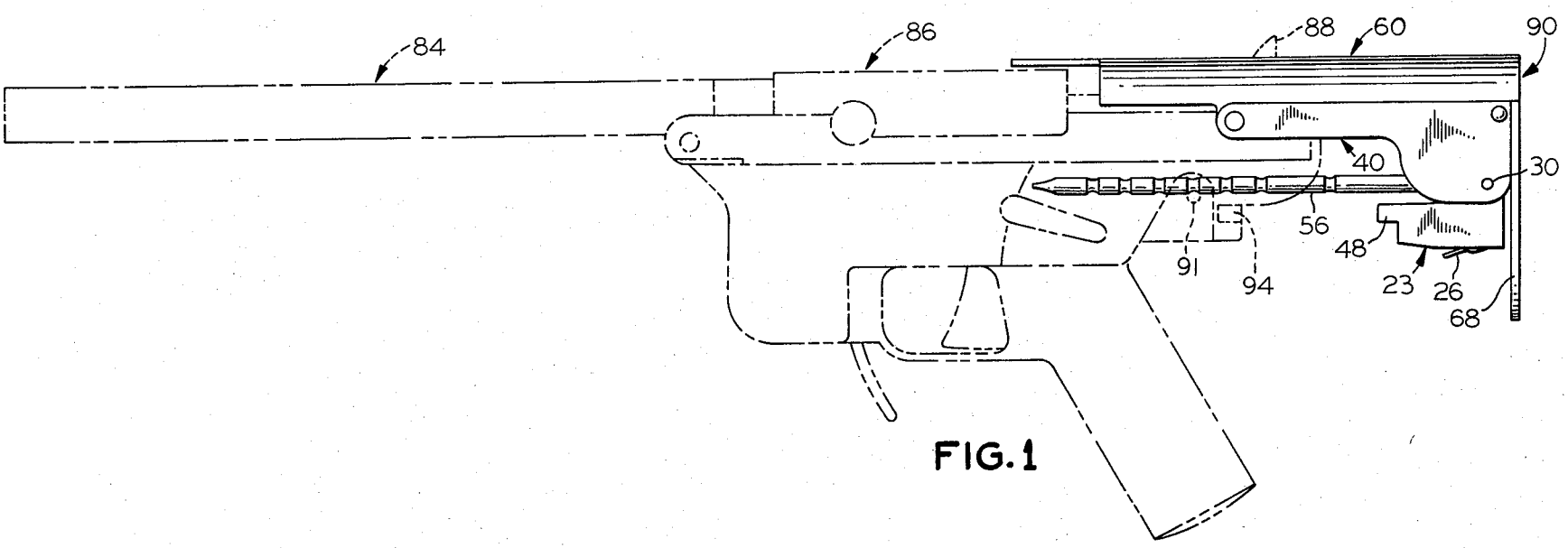
FIG. 1 is a side elevation of a submachine gun employing the folding stock of the present invention, the receiver and barrel portions being shown in phantom.
Figure 2:
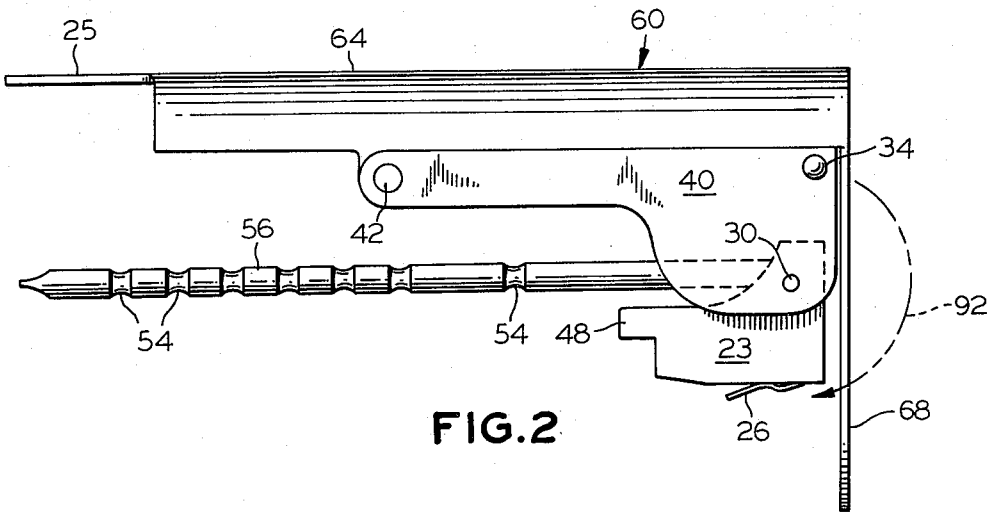
FIG. 2 is an enlarged side elevation of the folding stock of the present invention.
Figure 3:
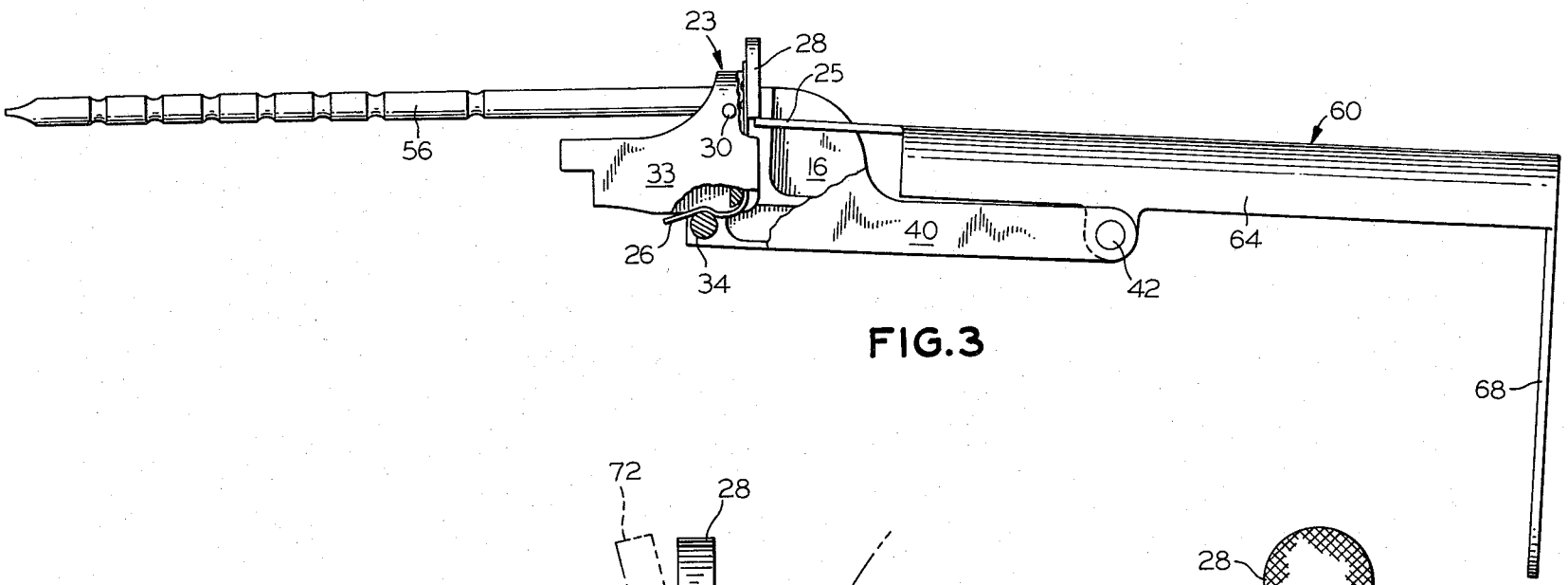
FIG. 3 illustrates the folding stock in its extended position.

FIG. 1 is a side elevation of a submachine gun. Its barrel 84 extends forward from its receiver, indicated generally by reference numeral 86. Both the receiver and the barrel are shown in phantom. According to the present invention, the firearm is provided with a foldable stock, indicated generally by reference numeral 90 and shown in more detail in FIG. 2. In FIG. 2, it is seen that the folding stock is made of three major parts, the mount 23, a pivot arm seen in FIG. 2 as pivot plate 40, and a butt member 60. Pivot plate 40 is pivotably mounted on mount 23, and butt member 60 is in turn pivotably mounted on pivot plate 40. Folding stock 90 is shown in its collapsed position in FIGS. 1 and 2, although FIG. 1 does not show mount 34 in its fully inserted position. The total length of the firearm illustrated in FIG. 1 is not as short as is possible with total insertion of mount 23. By pivoting pivot plate 40 with respect to mount 23 and pivoting butt member 60 with respect to the pivot arm, folding stock 90 can assume the extended position illustrated in FIG. 3.

Figure 4:
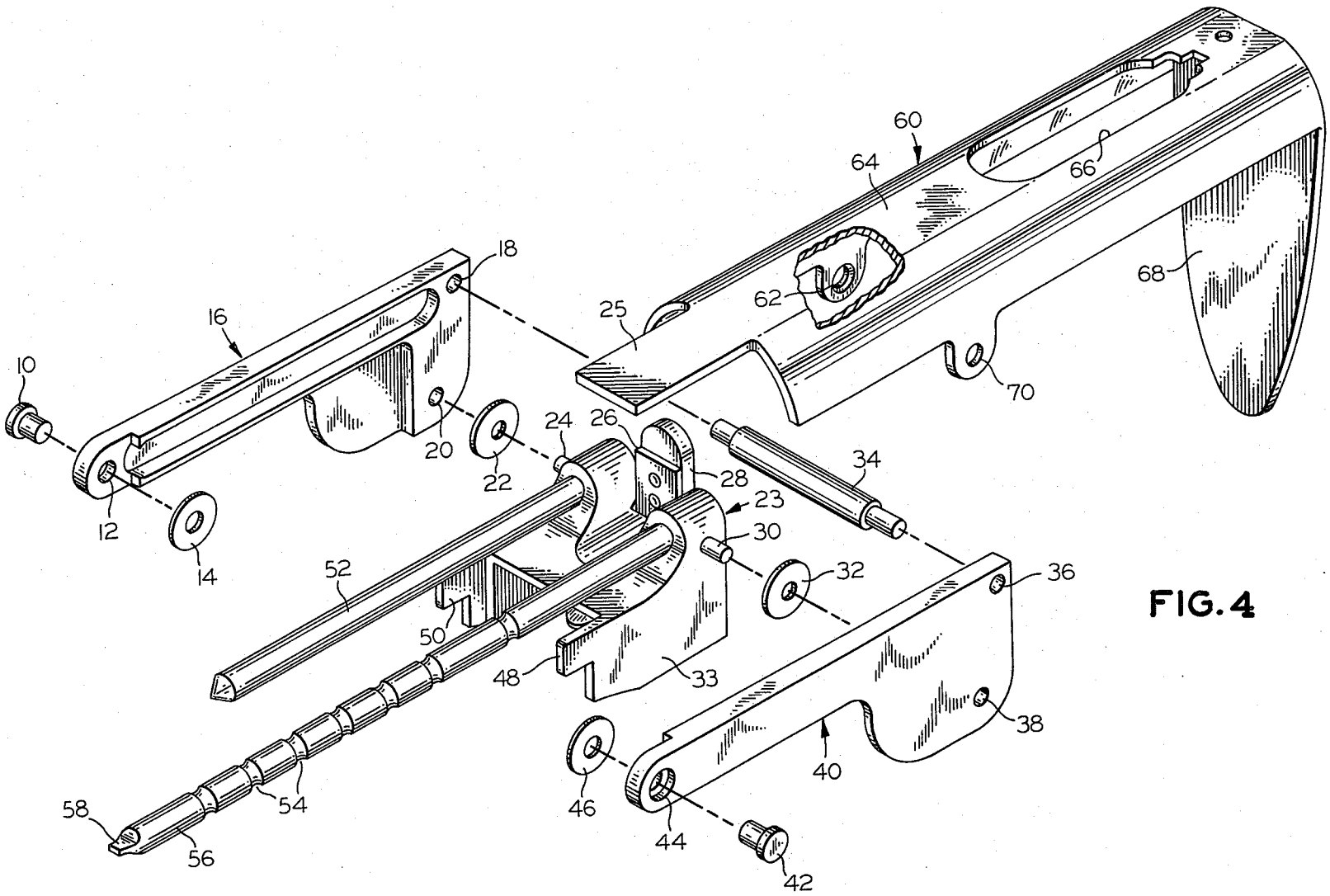
FIG. 4 is an exploded view of the folding stock.

The folding stock is illustrated in more detail in FIG. 4. A mount 23 of somewhat irregular shape acts as a pivot means. The mount includes a body portion 33 and two fingers 52 and 56 extending forward from it. Two coaxial pivot pins 24 and 30 extend laterally from mount body portion 33 to define the pivot axis of the mount. Finger 56 includes a screwdriver tip 58 that can be employed during assembly and disassembly of the weapon.

A pivot arm is pivotably mounted on mount 23 and includes generally elongated pivot plates 16 and 40, which include apertures 20 and 38, respectively, in their lower right corners. Apertures 20 and 38 receive pivot pins 24 and 30, respectively, and appropriate washers 22 and 32 are included between plates 16 and 40, respectively, and the side surfaces of body portion 33 of mount 23. Thus, the pivot arm that includes plates 60 and 40 is pivotable about the pivot axis of the mount, which extends through pivot pins 24 and 30 and apertures 20 and 38.

Plates 16 and 40 also have apertures 18 and 36 vertically spaced from apertures 20 and 38. These apertures receive opposite ends of a latch bar 34. As is apparent in FIG. 2, the ends of latch bar 34 are deformed to provide rivet heads that hold one end of each of the pivot plates together as a pivot arm.

A butt member 60 includes an elongated stock portion 64 and a butt-plate portion 68 that extends downward from the rear of the stock portion. Stock portion 64 is narrowed at its forward end to provide a generally rectangular tongue 25. The upper surface of stock portion 64 has an elongated opening 66 that accommodates the rear sight of the weapon when the folding stock is in its folded position. About one-third of the way back from the front end of stock portion 64 are provided tabs with holes 62 and 70 on the lower edges of opposite sides of the stock portion. Hole 62 receives a rivet 10 that extends through a hole 12 in the forward end of pivot plate 16 and then through an appropriate washer 14 into hole 62. Plate 40 is similarly riveted to stock portion 64 by a rivet 42 extending through a hole 44 in the forward end of plate 40 and then through a washer 46 and into hole 70 in stock portion 64.

FIG. 2 illustrates the assembled stock with the various pieces in the general orientation of FIG. 4. Longitudinal recesses in the rear of receiver 86 receive fingers 52 and 56, which extend forward from body portion 33 of mount 23. The extended length (and, concomitantly, the collapsed length) of the weapon can be adjusted by varying the depth of insertion of fingers 52 and 56 into the rear recesses of the receiver. The stock is secured at a given depth through the engagement of one of the circumferential grooves 54 on finger 56 by, for instance, a latching pin 91 (FIG. 1) that extends into a finger-receiving recess.

As FIG. 1 illustrates, pivot plate 40 extends along one side of receiver 86, while stock portion 64 extends along its upper surface. Also illustrated in FIG. 1 is a rear sight 88, which is shown in phantom. Because of opening 66 in the upper surface of stock portion 64, sight 88 is ordinarily permitted to protrude through the upper surface of butt member 60 when the folding stock is in its folded position. An opening of the specific size illustrated in FIG. 4 would not accommodate sight 88 with the folding stock in the relatively retracted position illustrated in FIG. 1, but if such an accommodation were desired, opening 66 could, of course, be appropriately expanded.

When it is desired to unfold the stock into its extended position, butt member 60 is moved upward and rearward with its stock portion 64 maintaining an approximately horizontal orientation. As this motion takes place, the pivot arm (evidenced in FIG. 2 by pivot plate 40) rotates about the pivot axis of the mount, and latch bar 34 follows path 92 of FIG. 2. When the folding stock assumes the fully extended position illustrated in FIG. 3, it is locked in place by locking means illustrated in detail in FIGS. 5, 6, and 7.

Figure 7:
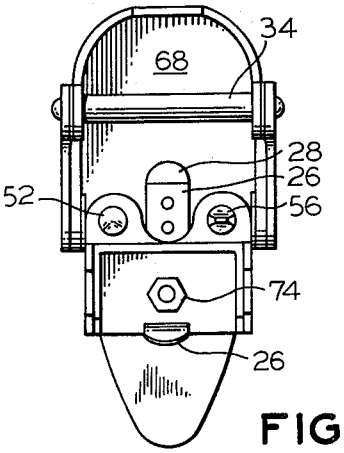
FIG. 7 is a front elevation of the folding stock of FIG. 2.
Figure 6:
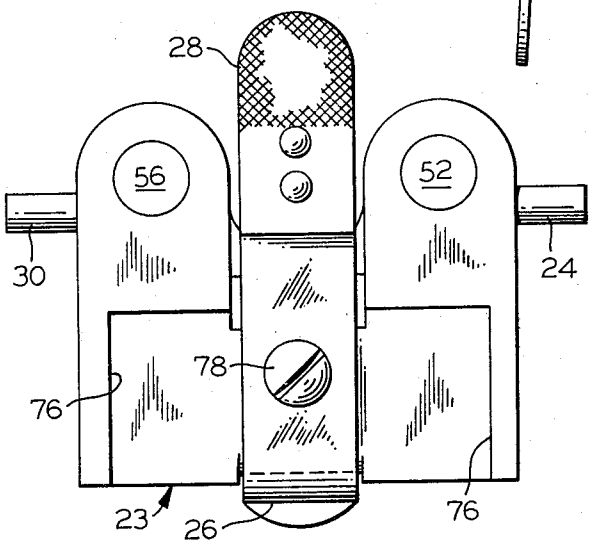
FIG. 6 is a rear elevation of the mount of FIG. 5.
Figure 5:
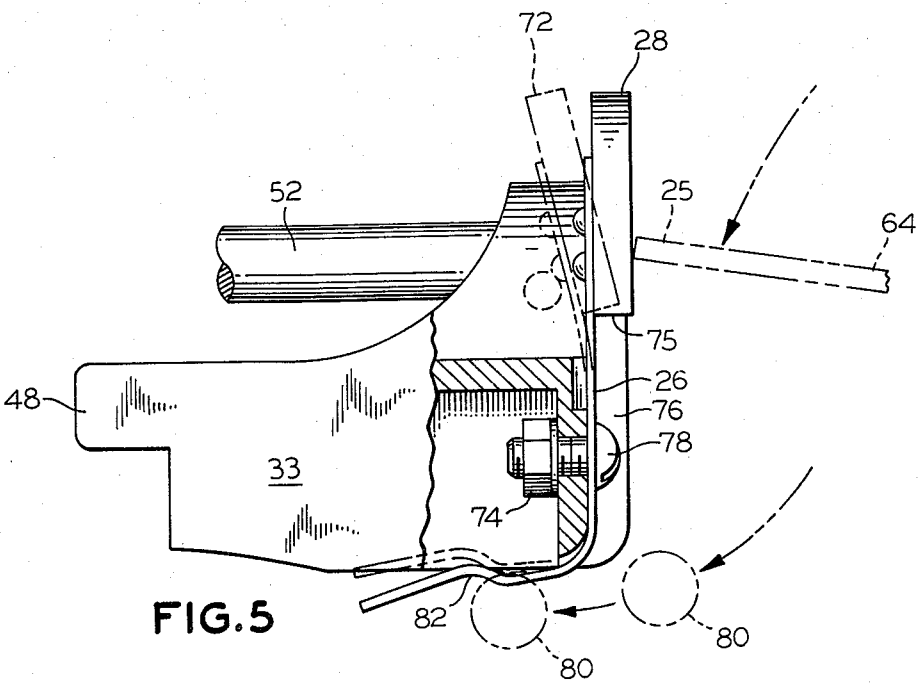
FIG. 5 is a side elevation, partly broken away, of the mount employed in the illustrated folding stock.

FIGS. 5, 6, and 7 illustrate a generally L-shaped leaf spring 26 that is fastened in a rear recess of mount body portion 33 by a screw 78 that extends through spring 26 and the rear wall of mount 33 and is threadedly engaged by a nut 74. As FIGS. 5 and 6 illustrate, the recess that receives spring 26 is formed by relieving the rear wall of mount 23 to leave parallel vertical surfaces 76 in the rear wall.

Spring 26 serves as part of locking means both for latch bar 34, represented in FIG. 5 by phantom 80, and for tongue 25 of the stock portion 64 of butt member 60. The horizontal, forwardly extending portion of spring 26 provides a detent 82 in which latch bar 34 (FIG. 3) is seated when the stock is in its extended position. It will be appreciated that spring 26 must be resiliently deflected in order to allow latch bar 34 to move into or out of detent 82. Accordingly, the lower portion of spring 26 is a spring means that acts as a locking mechanism for the pivot arm.

The weapon may be transported in the position illustrated in FIG. 1, although finger 54 would typically be inserted farther than is shown in FIG. 1. In the farthest inserted position, tab 48 of mount 23 fits in a groove 94 provided on the side of receiver 86. A corresponding groove on the other side of receiver 86 receives tab 50 (FIG. 4). In the folded position, butt plate 68 is in an orientation that is substantially the same as that which it assumes in the extended position, thereby facilitating shooting from the hip, for instance.

When it is desired to unfold stock 90 for ordinary firing from the shoulder, butt member 60 is moved upward to cause the pivot arm to pivot around the axis of pivot pin 30. Latch bar 34 follows path 92 of FIG. 2 until it engages the lower portion of spring 26. At that point, it deflects spring 26, as is suggested by phantoms 80 of FIG. 5, until it is seated in detent 82 of spring 26.

With the pivot arm now locked in position, butt member 60 is pivoted forward about the axis of rivets 10 and 42 until tongue 25 engages block 28, as is illustrated in FIG. 5. Phantom 72 of FIG. 5 suggests the deflection that occurs upon further downward motion of tongue 25, which continues until tongue 25 has passed latch surface 75 of block 28. At this point, butt member 60 is locked in position.

When it is desired to fold the stock again, block 28 is pressed forward until tongue 25 can clear surface 75, and butt member 60 is then pivoted back. It is then pushed upward to cause the pivot arm to pivot about the axis of the mount. This requires the lower portion of spring 26 to deflect upward to permit latch bar 34 to move out of detent 82 in spring 26. Pivoting of the pivot arm about the mount axis then continues until it has assumed the position illustrated in FIG. 1, and the butt member is simultaneously lowered into the position illustrated there. It may be desirable to provide a latch for the stock in its folded position by, for instance, forming the opening in the upper surface of butt member 60 in such a configuration as to engage the rear of the rear sight on the weapon, but this feature is not illustrated in the drawings.

It is apparent that a weapon with the folding stock described above incorporates the advantages of both the sliding stock and the folding stock. Like the sliding stock, the stock of the present invention permits the butt plate to assume its operational orientation in both the collapsed and the extended positions of the stock. However, it dispenses with the excessive forward extension along the sides of the weapon that is usually a feature of sliding stocks. Additionally, this stock incorporates a feature not found in most collapsible stocks of either variety, namely, that the stock is inclined downwardly in the extended position to permit comfortable sighting. Finally, all these advantages are provided in a simple mechanism that is easy to maintain.

Having thus described the invention, I claim:

1. A firearm comprising:

a. a receiver portion;

b. a barrel extending from one end of said receiver portion; and c. a foldable stock assembly on the other end of said receiver portion and including:

(i) an elongated pivot arm;

(ii) pivot means detachably secured to said other end of said receiver portion and pivotably mounting one end of said pivot arm on said receiver portion for movement between a first position in which said pivot arm extends away from said other end of said receiver portion and a second position in which said pivot arm extends towards said barrel; and (iii) a butt member including an elongated stock portion and a butt-plate portion at one end thereof, said stock portion being pivotably mounted on said pivot arm adjacent the other end of said pivot arm for pivoting between a first position in which said stock portion extends away from said receiver portion and rearwardly of said pivot arm when said pivot arm is in its first position and a second position in which it extends longitudinally of said firearm along the upper surface of said receiver portion when said pivot arm is in its second position, said one end of said butt member being disposed rearwardly of said receiver portion in either position thereof, said butt portion extending at an angle to the longitudinal axis of said stock portion to bear against the body of a user when said butt member is in either of said pivoted positions.

2. The firearm of claim 1 further including pivot-arm locking means for locking said pivot arm in its first position and butt-member locking means for locking said butt member in its first position when said pivot arm is in its first position.

3. The firearm of claim 2 wherein said pivot-arm locking means includes resiliently deflectable spring means on said pivot means and an engagement surface on said pivot arm, said spring means providing a detent, said engagement surface being spaced from the pivot axis of said pivot means to move upon pivoting of said pivot arm, said engagement surface engaging said spring means and being disposed in said detent therein when said pivot arm is in said first position, pivoting of said pivot arm from said first position requiring movement of said engagement surface out of said detent by resilient deflection of said spring means, said spring means and said engagement surface thereby locking said pivot arm in its first position.

4. The firearm of claim 3 wherein said butt-member locking means includes:

a. second resiliently deflectable spring means on said pivot means, said second spring means providing a detent thereon; and b. an engagement surface on said stock portion of said butt member spaced from the pivot axis of said butt member, said engagement surface engaging said second spring means and being disposed in said detent therein when said butt member and said pivot arm are in said first positions thereof, movement of said butt member out of said first position requiring movement of said engagement surface out of said detent by resilient deflection of said spring means, said spring means and said engagement surface thereby locking said butt member in said first position thereof.

5. The firearm of claim 1 wherein said pivot means includes a body portion and at least one elongated finger portion extending longitudinally from said body portion of said pivot means, and wherein said receiver portion provides a longitudinally extending recess in the rear thereof associated with each finger portion of said pivot means and receiving the associated finger portion member therein.

6. The firearm of claim 5 wherein said pivot arm includes a pair of generally elongated pivot plates each pivotably mounted at one end thereof on said body portion of said pivot means for pivoting about the pivot axis of said pivot means, each of said pivot plates being pivotably mounted at the other end thereof on said butt member for pivoting about the pivot axis of said butt member, said pivot plates being horizontally spaced and extending longitudinally along opposite sides of said receiver portion when said pivot arm is in said second position thereof.

7. The firearm of claim 6 wherein said pivot arm includes a locking bar extending between said pivot plates at said one end thereof and spaced from the pivot axis of said pivot means to extend under said pivot means when said pivot arm is in said first position, said pivot means including spring means providing a detent receiving said locking bar when said pivot arm is in said first position, pivoting of said pivot arm from said first position requiring movement of said locking arm out of said detent by resilient deflection of said spring means, said locking bar and said spring means thereby locking said pivot arm in its first position.

8. The firearm of claim 1 wherein said receiver portion thereof provides a rear sight on its upper surface near the rear thereof and wherein said stock portion has an aperture therein in which said rear sight is received when said pivot arm and said butt member are in their second positions.

9. The firearm of claim 1 wherein said butt member is inclined from the horizontal in said first position thereof.

10. The firearm of claim 1 wherein said pivot arm includes a pair of generally elongated pivot plates each pivotably mounted at one end thereof on said pivot means for pivoting about the pivot axis of said pivot means, each of said pivot plates being pivotably mounted at the other end thereof on said butt member for pivoting about the pivot axis of said butt member, said pivot plates being horizontally spaced and extending longitudinally along opposite sides of said receiver portion when said pivot arm is in its second position.

11. The firearm of claim 10 wherein said pivot arm includes a locking bar extending between said pivot plates at said one end thereof and spaced from the pivot axis of said pivot means to extend under said pivot means when said pivot arm is in said first position, said pivot means including spring means providing a detent receiving said locking bar when said pivot arm is in said first position, pivoting of said pivot arm from said first position requiring movement of said locking arm out of said detent by resilient deflection of said spring means, said locking bar and said spring means thereby locking said pivot arm in its first position.

* * * * *